US006264056B1

(12) United States Patent
King

(10) Patent No.: US 6,264,056 B1
(45) Date of Patent: Jul. 24, 2001

(54) TUB BOX

(75) Inventor: Daniel F. King, Menifee, CA (US)

(73) Assignee: Oatey Co., OH (US)

( * ) Notice: Subject to any disclaimer, the term of this patent is extended or adjusted under 35 U.S.C. 154(b) by 0 days.

(21) Appl. No.: 09/343,157

(22) Filed: Jun. 29, 1999

(51) Int. Cl.[7] ..... B65D 88/76

(52) U.S. Cl. ..... 220/484; 206/518; 206/519; 220/4.24

(58) Field of Search ..... 220/484, 4.24; 206/518, 519

(56) References Cited

U.S. PATENT DOCUMENTS

| | | | | |
|---|---|---|---|---|
| 2,986,300 | * | 5/1961 | Parrish | 220/4.24 |
| 2,999,611 | * | 9/1961 | Paulson | 220/4.24 |
| 3,251,460 | * | 5/1966 | Edmonds | 220/4.24 |
| 3,593,344 | | 7/1971 | Logsdon . | |
| 3,596,695 | * | 8/1971 | Stevenazzi | 220/4.24 |
| 3,620,403 | * | 11/1971 | Rump | 220/4.24 |
| 4,742,585 | | 5/1988 | Logsdon . | |
| 4,925,045 | | 5/1990 | Logsdon . | |

* cited by examiner

*Primary Examiner*—Joseph M. Moy
(74) *Attorney, Agent, or Firm*—Renner, Otto, Boisselle & Sklar, LLP

(57) ABSTRACT

A tub box for receiving a drain trap is formed from two substantially identical plastic housing portions each including one or more round knockouts in one or more side walls of the housing portions and one or more edge flange knockouts in an edge flange of each housing portion and side walls in line with and terminating in close proximity to the respective round knockouts. Pull tabs on the round knockouts facilitate removal of the round knockouts from the housing portions and limit the amount of nesting of the housing portions inside one another when stacked for storage and shipment so the housing portions can easily be pulled apart when desired. A lip protrudes axially outwardly from the radial outer edge of the edge flange of each housing portion around one half only of the periphery of each edge flange for overlapping engagement with the outer edge of the edge flange of an other housing portion when the edge flanges of two housing portions are placed in engagement with one another.

22 Claims, 5 Drawing Sheets

TUB BOX

FIELD OF THE INVENTION

This invention relates to certain improvements in tub boxes used to form a cavity in a concrete slab for installing a tub waste and drain or the like.

BACKGROUND OF THE INVENTION

Tub boxes are commonly used to form a cavity in a concrete slab for receiving a trap for a bath tub or the like so the tub can easily be connected to the drain system. Typically such tub boxes comprise two identical plastic housing portions fitted together, each including continuous side walls forming a hollow enclosure open at one end and closed at the other end. Surrounding the open end of each housing portion is a radially outwardly protruding edge flange adapted to be placed in mating engagement with the edge flange of another housing portion to form a joint therebetween.

Suitable round knockouts are provided in one or more side walls, and if desired, in the closed end wall of each housing portion. When removed, these knockouts provide one or more round access openings for passage of a pipe used to connect the trap within the tub box to the drain system. Also, it is generally known to extend the knockouts in the side walls all the way to the open end of each housing portion so that when one of the knockouts is removed, the plumber can locate the pipe in the resulting knockout opening without having to insert the end of the pipe through the knockout opening.

In some installations the plumber may want a round knockout opening in a side wall of the tub box in order to provide a close fit with a round pipe extending through the opening, whereas in other installations the plumber may want the convenience of having the knockout opening extend all the way to the open end of the housing portion to eliminate having to insert the end of the pipe through the opening. This has the drawback that the same tub box could not be used for both applications.

Another drawback of previous tub boxes is that the joint that is formed between the engaging edge flanges of two housing portions is not always effective in keeping concrete or dirt that is placed around the tub box after installation from entering the tub box between the flange portions.

Moreover, when adhesive is used to bond the edge flanges of the housing portions together to secure the trap cavity within the box from concrete, rodents and vermin, it is sometimes difficult to keep a bead of adhesive in place on the edge flanges of the housing portions before the edge flanges are pressed into engagement with each other.

Further, it is somewhat difficult to cut off the top portions of previous tub boxes that protrude above the concrete slab. Also, there is a risk that if the top portions of the tub boxes are inadvertently kicked or hit before they are cut off, they might break off with a jagged break and have to be dug out and replaced.

Another disadvantage of previous tub boxes is that the housing portions sometimes stick together when stacked during storage and shipping, making it difficult to pull them apart when desired.

SUMMARY OF THE INVENTION

In accordance with one aspect of the invention, the tub box of the present invention is formed from two substantially identical plastic housing portions each including one or more round knockouts in one or more side walls of the housing portions and one or more edge flange knockouts in an edge flange surrounding an open end of the housing portions and the side walls in line with the round knockouts and terminating in close proximity to the round knockouts. This gives the plumber/installer the flexibility of being able to remove only the round knockouts to provide round openings in one or more side walls, or to remove both the round knockouts and associated edge flange knockouts to extend the knockout openings all the way to the open end of the housing portions if desired.

In accordance with another aspect of the invention, the round knockouts in the side walls of the housing portions are formed by a thinner frangible section than the edge flange knockouts to permit removal of the round knockouts without removing the edge flange knockouts.

In accordance with another aspect of the invention, pull tabs are provided on the round knockouts in the side walls of the housing portions to facilitate removal of the round knockouts from the housing portions.

In accordance with another aspect of the invention, the pull tabs are located a predetermined distance from the closed end of each housing portion to limit the amount of nesting of the housing portions inside one another when stacked for storage and shipment so the housing portions won't stick together when they are pulled apart.

In accordance with another aspect of the invention, reinforcement ribs are provided on the underside of the edge flange of each housing portion in circumferentially spaced relation to the pull tabs which terminate in line with the pull tabs to provide in conjunction with the pull tabs a series of stacking stops limiting the amount of nesting of the housing portions inside one another.

In accordance with another aspect of the invention, a lip protrudes axially outwardly from the radial outer edge of the edge flange around one half of the periphery of the open end of each housing portion whereby when the edge flanges of two housing portions are placed in engagement with one another, the lips of each housing portion overlap the outer edge of the other housing portion to act as a dam to prevent concrete or dirt that is placed around the tub box after installation from seeping into the tub box between the engaging edge flanges.

In accordance with another aspect of the invention, the axially protruding lip and adjacent edge flange of each housing portion form a generally L-shape pocket or recess for holding a bead of adhesive on the edge flanges of two housing portions before the edge flanges are pressed into engagement with each other to permanently bond the housing portions together.

In accordance with another aspect of the invention, a plurality of axially spaced, circumferentially extending score lines are provided in the side walls of each housing portion for ease of breaking or sawing off the top portion of the tub box protruding above a concrete slab that is poured around the tub box after installation.

In accordance with still another aspect of the invention, the score lines are in the exterior of the side walls of the housing portions rendering them easily visible from the exterior of the tub box.

In accordance with another aspect of the invention, concentric smaller and larger diameter knockouts may be provided in the closed end wall of each housing portion, the smaller diameter knockout being formed by a thinner frangible section than the larger diameter knockout to permit removal of the smaller diameter knockout without removing the larger diameter knockout.

In accordance with another aspect of the invention, a pull tab protrudes outwardly from the small diameter knockout in the closed end wall of each housing portion to aid in removal of the smaller diameter knockout without removing the larger diameter knockout.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
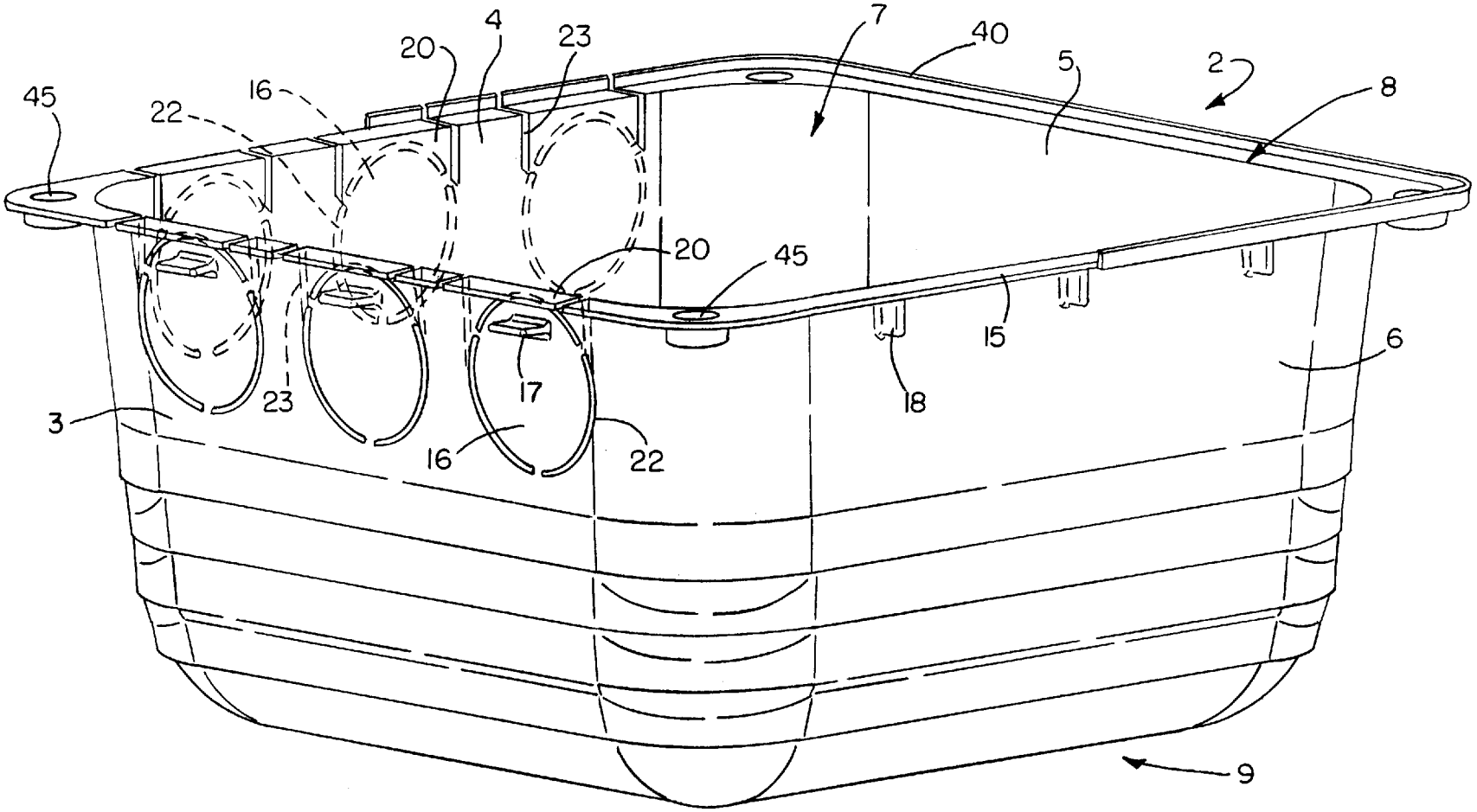
FIG. 1 a perspective view of one of the housing portions of a preferred form of tub box in accordance with this invention as viewed from the upper front and left hand side of the housing portion.
Figure 2:
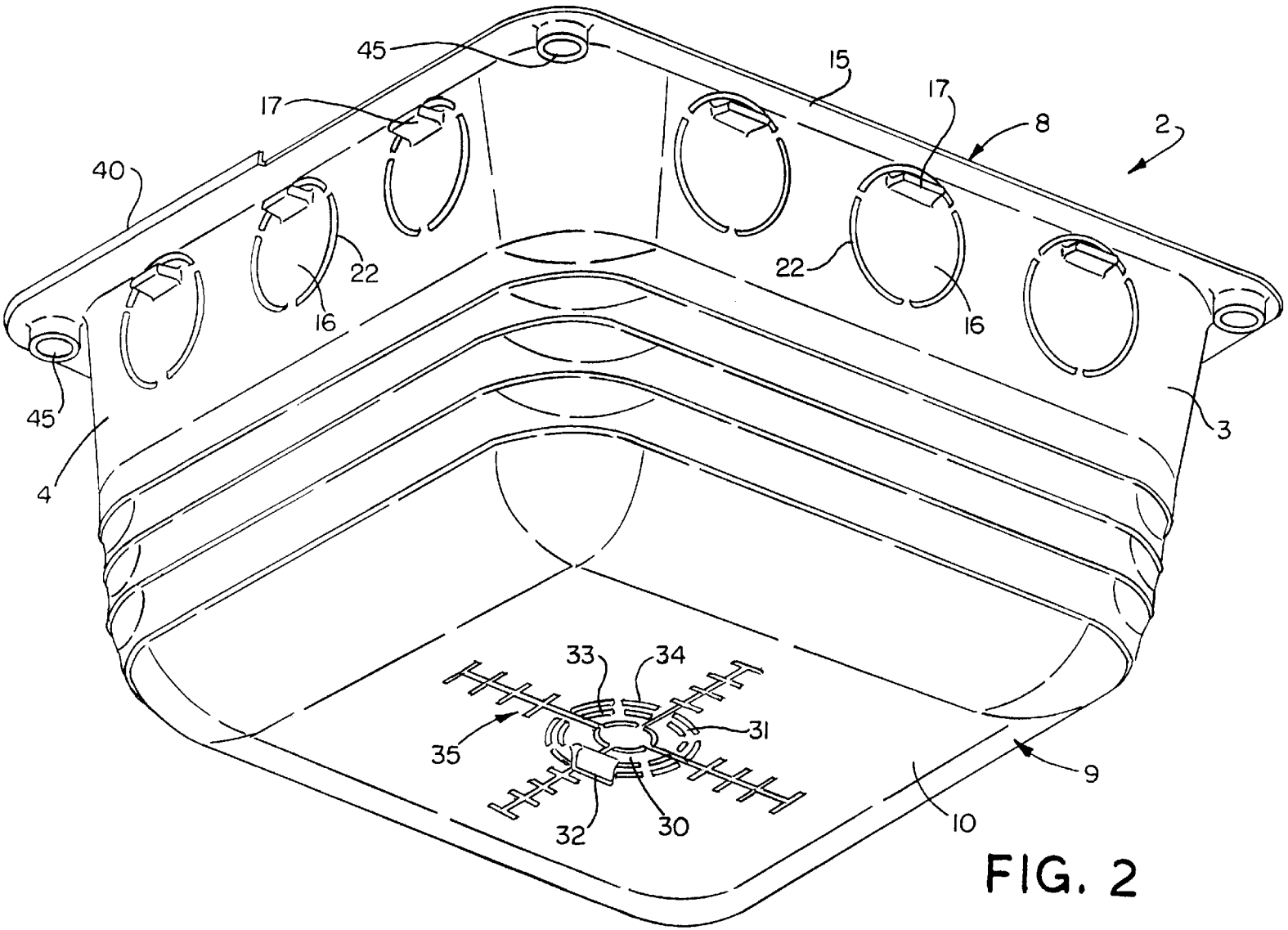
FIG. 2 is a perspective view of the housing portion of FIG. 1 as viewed from the bottom and rotated clockwise 90° from the FIG. 1 position.
Figure 5:
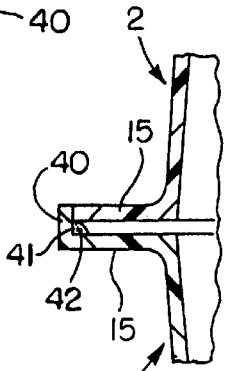
FIG. 5 is a schematic side elevation view, partly in section, showing a typical installation of the tub box of the present invention.
Figure 5:
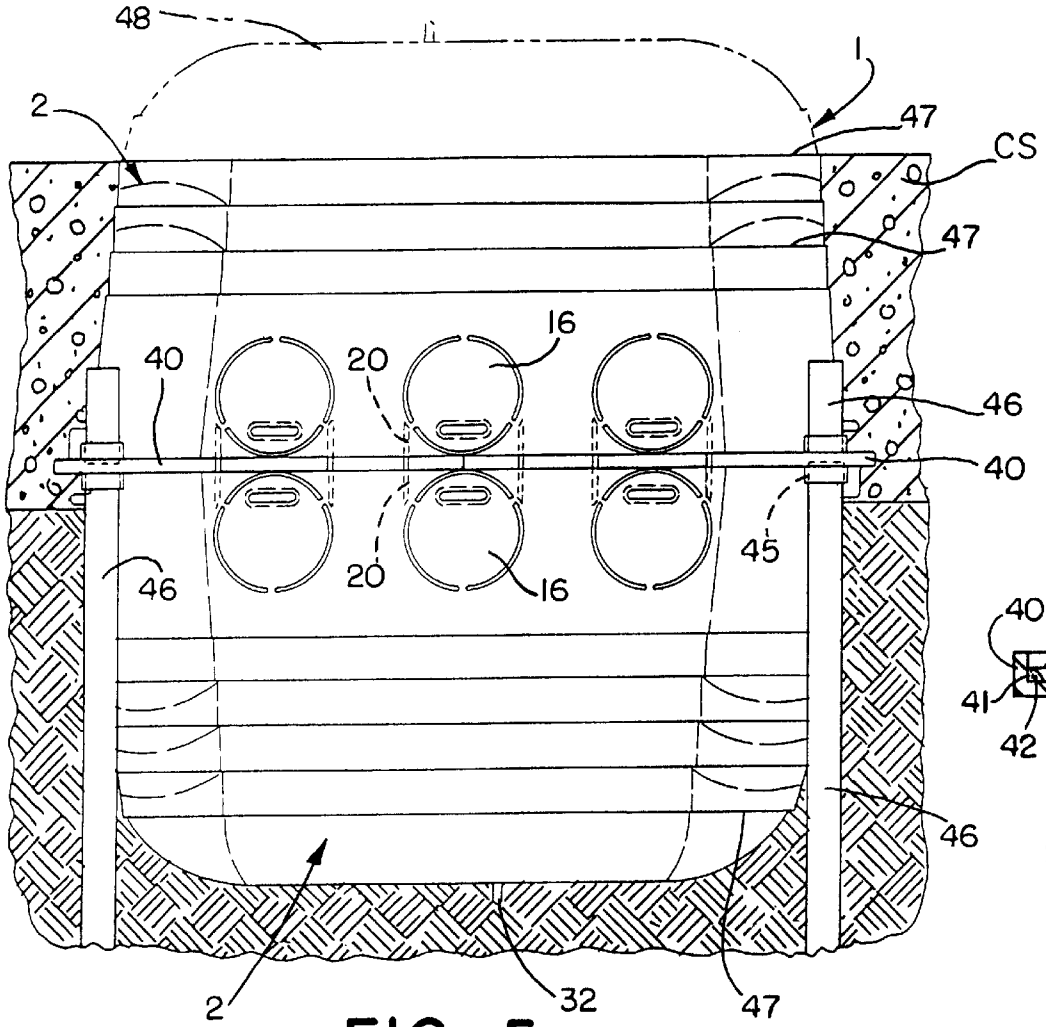

The tub box 1 of the present invention is shown in FIG. 5 formed from two identical housing portions 2 preferably made of a suitable plastic. As best seen in FIGS. 1 and 2, each housing portion 2 is desirably generally rectangular in shape including four continuous side walls 3–6 forming a hollow enclosure 7 open at one end 8 and closed at the other end 9 by an end wall 10 integrally formed with each of the side walls. However, it will be appreciated that the housing portions could be of other shapes having more or less than four sides if desired.

Surrounding the open end 8 of each housing portion 2 is a radially outwardly protruding edge flange 15. The edge flanges 15 of two housing portions 2 are adapted to be placed in mating engagement with each other to form a cavity in a concrete slab CS as schematically shown in FIG. 5 for connection of a trap from the tub waste or the like to the drain system.

One or more knockouts are provided in one or more of the side walls 3–6, and if desired, in the closed end wall 10 of each housing portion 2 which when removed form a round opening for insertion of a pipe for connecting the trap located within the tub box to the drain system.

In the embodiment disclosed herein, three round knockouts 16 all of substantially the same diameter are provided in two adjacent side walls 3, 4 of each housing portion 2. However, it will be appreciated that a greater or lesser number of knockouts of the same or different diameters may be provided in a greater or lesser number of side walls if desired. For example, three 1½ inch diameter knockouts may be provided in one side wall and three 2 inch diameter knockouts may be provided in the adjacent side wall.

Preferably the round knockouts 16 in the side walls of each housing portion are located closely adjacent to but do not intersect the edge flange 15 of each housing portion. Protruding outwardly from the knockouts 16 are pull tabs 17 for gripping by a pliers to aid in removal of the knockouts from the side walls as desired.

Figure 3:
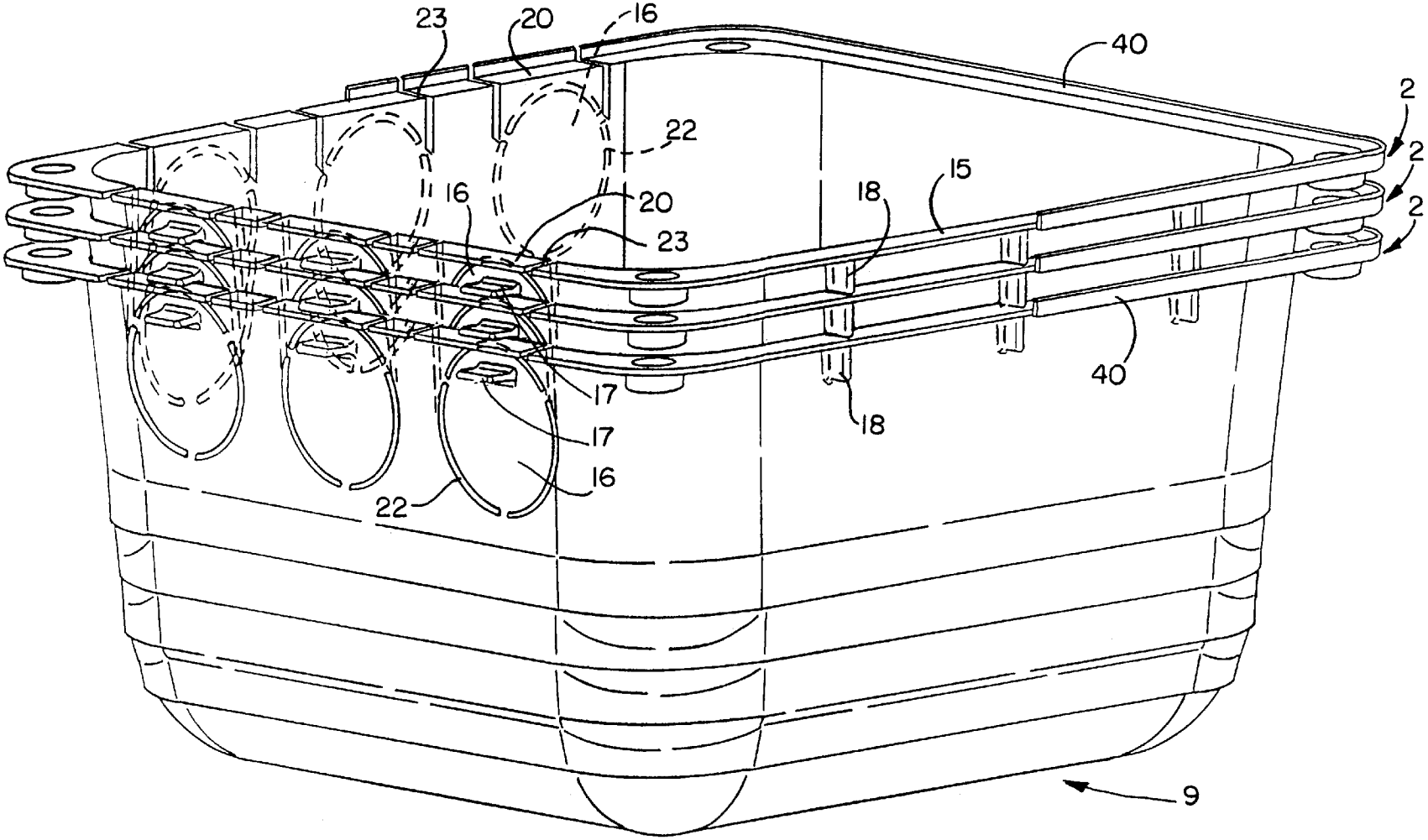
FIG. 3 is a perspective view similar to FIG. 1 but showing several such housing portions stacked inside one another.

The side walls 3–6 of the housing portions 2 have a slight inward taper from the open end 8 to the closed end 9 to facilitate removal of the housing portions from the mold during molding, and to permit a plurality of housing portions to be stacked inside one another for ease of storage and shipment. To insure that the housing portions 2 won't stick together when stacked, the pull tabs 17 are desirably located a predetermined distance from the closed end 10 of the housing portions to limit the amount of nesting of the housing portions inside one another so they can be easily pulled apart. Also, reinforcement ribs 18 are desirably provided on the underside of the edge flange 15 of each housing portion in circumferentially spaced relation to the pull tabs. These reinforcement ribs 18, which are on the outside of the housing portions, terminate in circumferential alignment with the pull tabs 17 to provide in cooperation with the pull tabs a series of stacking stops limiting the amount of nesting of the housing portions inside one another as schematically shown in FIG. 3.

In addition to the round knockouts 16 in one or more of the side walls of the housing portions, one or more substantially rectangular edge flange knockouts 20 are provided in the edge flange 15 and respective side walls in line with one or more of the round knockouts. FIGS. 1 and 3 show an edge flange knockout 20 in line with each round side wall knockout 16. However, it will be appreciated that a lesser number of edge flange knockouts than round side wall knockouts could be provided if desired.

Each edge flange knockout 20 terminates in close proximity to the respective round side wall knockout 16, whereby when the edge flange knockouts are removed along with the respective round knockouts, a generally U-shaped knockout opening 26 (see FIG. 4) is provided in the respective side walls that extends through the edge flange 15 of the housing portion.

The frangible sections/grooves 22 in the respective side walls that form the round knockouts 16 are thinner/deeper than the frangible sections/grooves 23 in the edge flange 15 and respective side walls, whereby the round knockouts can be removed by pulling on the pull tabs 17 without removing the edge flange knockouts if desired. In some cases it may be necessary to use a hammer and screwdriver to break part way through the frangible sections 22 and 23 for the round and edge flange knockouts 16 and 20 before such knockouts can be removed. Preferably the grooves 22 that form the frangible sections for the round knockouts 16 are formed in the exterior surface of the respective side walls, whereas the grooves 23 that form the frangible sections for the edge flange knockouts 20 are desirably in the top of the edge flange 15 and interior surface of the respective side walls as schematically shown in FIGS. 1 and 3.

Figure 4:
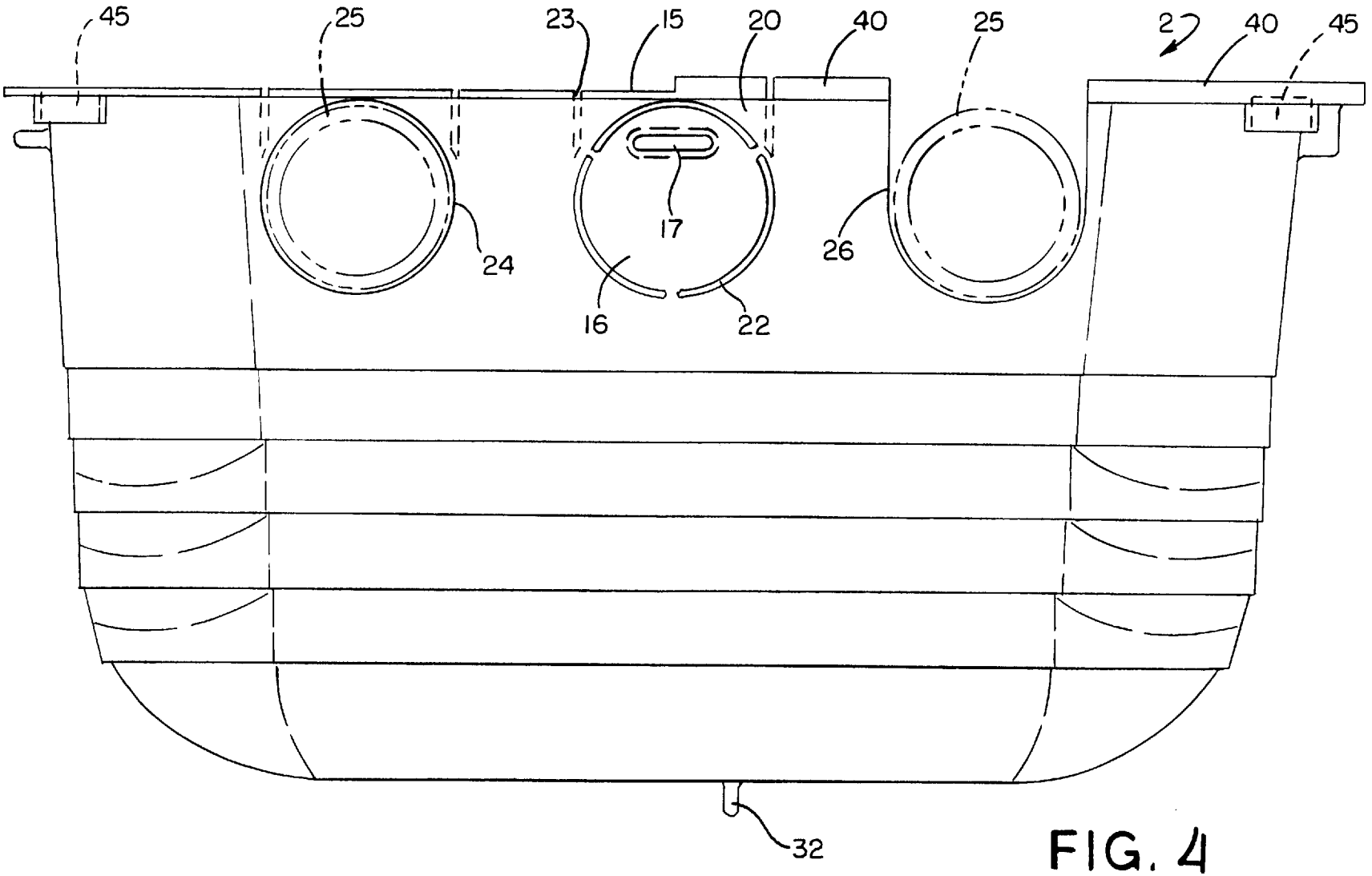
FIG. 4 is a side elevation view of the left hand side of the housing portion of FIG. 1 showing one of several round knockouts removed therefrom to provide a round knockout opening in the side wall and an other round knockout and associated edge flange knockout removed to provide a generally U-shaped knockout opening extending all the way to the open end of the housing portion.

FIG. 4 shows a housing portion 2 having one of the round side wall knockouts 16 removed from one of the side walls to provide a round opening 24 for insertion of a round pipe 25 (shown in phantom lines) having a close fit within the round opening, and an other round knockout 16 and associated edge flange knockout 20 removed to provide a generally U-shaped knockout opening 26 extending through the edge flange 15 and associated side wall to permit placement of a pipe 25 into the knockout opening 26 without having to insert the pipe through the opening. The edge flange knockouts 20 are easily removed after the round side wall knockouts 16 are removed as by gripping the wall of the round knockout openings 16 common to the edge flange knockouts with a pliers and peeling the edge flange knockouts out of the edge flanges and respective side wall portions.

If desired, two concentric round knockouts 30 and 31 (shown in FIG. 2) having diameters for example of 1½ inches and 2 inches, respectively, may also be provided in the closed end wall 10 of each housing portion 2 to accommodate different diameter pipes through the closed end wall during installation of the tub box. A pull tab 32 desirably protrudes outwardly from the smaller diameter knockout 30 in the end wall for gripping by a pliers to remove the smaller diameter knockout. The frangible section/groove 33 for the smaller diameter knockout 30 is thinner/deeper than the frangible section/groove 34 for the larger diameter knockout 31 so the smaller diameter knockout can be removed without removing the larger diameter knockout. If a larger diameter opening is desired, the smaller diameter knockout 30 is first removed as by pulling on the pull tab 32 with a pliers and then using the pliers to peel out what is left of the larger diameter knockout 31. If necessary, a hammer and screwdriver may be used to assist in breaking through the knockouts 30 and 31 as desired.

Cross hairs 35, also schematically shown in FIG. 2, may be provided on the exterior surface of the end wall 10 of the housing portions to allow measurements to be taken to the center trap using the cross hairs on the top housing portion after the tub box has been installed and before the top of the tub box is removed.

Figure 6:
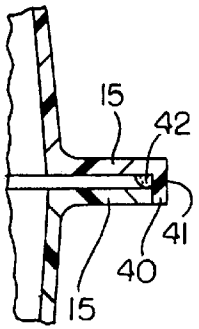
FIG. 6 is an enlarged fragmentary vertical section through the edge flanges of two housing portions placed against one another.

Protruding axially outwardly from the outer edge of the edge flange 15 around one half of the periphery of each housing portion 2 is a lip 40 which overlaps the edge flange of an other housing portion when two such housing portions are placed one on top of another with the edge flanges in engagement with each other as schematically shown in FIGS. 5 and 6 to act as a dam to help prevent earth material and/or concrete that is poured around the tub box 1 after installation from entering the tub box between the edge flanges. Also, the axially protruding lip 40 and respective edge flange 15 of each housing portion form a generally L-shape pocket or recess 41 for holding a bead 42 of a suitable adhesive such as solvent cement placed on both edge flanges before pressing the edge flanges against one another as further shown in FIG. 6 to permanently bond the two housing portions together to secure the trap cavity within the box from concrete, rodents and vermin.

In each corner of the housing edge flange 15 outwardly of the side walls is a corner support hole 45 through which a reinforcing bar 46 or the like may be inserted and driven into the ground for anchoring the two housing portions in place during the concrete pour as further shown in FIG. 5. Also, tie wires (not shown) may be used to secure each reinforcing bar stake to the tub box.

Figure 7:
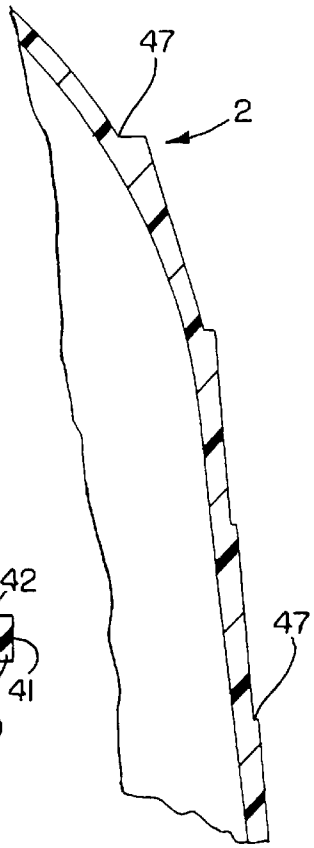
FIG. 7 is an enlarged fragmentary vertical section through one of the side walls of the housing portions showing axially spaced, circumferential score lines in the exterior surface of such side wall.

Extending peripherally around the exterior of the side walls 3–6 are a plurality of axially spaced score lines 47 which provide shear lines for ease of shearing off the top portion 48 of the tub box 1 as by breaking or sawing off the top portion of the box above the top surface of the concrete slab CS (see FIG. 5) after the concrete has set. Placing the score lines 47 on the exterior of the side walls renders them easily visible from the exterior of the tub box. The score lines 47 are desirably formed by stepping the outer surface of the side walls inwardly about 0.020 inch, for example, from about 0.070 inch to about 0.050 inch, at spaced apart intervals, for example, one half inch to three quarter inch, from the closed end of the housing portions in a ship lap arrangement as schematically shown in FIG. 7. Having such score lines greatly facilitates breaking or sawing off the top portion of the tub box at the closest score line above the top surface of the concrete slab.

Although the invention has been shown and described with respect to a certain preferred embodiment, it is obvious that equivalent ZY) alterations and modifications will occur to others skilled in the art upon the reading and understanding of the specification. The present invention includes all such equivalent alterations and modifications, and is limited only by the scope of the claims.

What is claimed is:

1. A plastic housing portion used to make a tub box for receiving a drain trap comprising a plurality of continuous side walls forming a hollow enclosure open at one end and closed at an other end, said open end being surrounded by a radial outturned edge flange, at least one round knockout in at least one of said side walls which when removed forms a round opening in said one side wall, and at least one edge flange knockout in said edge flange and said one side wall in line with said round knockout, said edge flange knockout terminating in close proximity to said round knockout whereby when said edge flange knockout is removed along with said round knockout, a knockout opening is formed in said one side wall that extends to the open end of said housing portion, said round knockout being formed by a thinner frangible section in said one side wall than said edge flange knockout to permit removal of said round knockout without removing said edge flange knockout.

2. The housing portion of claim 1 further comprising a plurality of axially spaced, circumferentially extending score lines in said side walls for ease of breaking or sawing off an end portion of said housing portion, said score lines being on an exterior surface of said side walls making said score lines easily visible from the exterior of said housing portion.

3. The housing portion of claim 1 further comprising a lip extending axially outward from an outer edge of said edge flange around one half only of the periphery of said edge flange.

4. The housing portion of claim 1 further comprising a pull tab protruding outwardly from said round knockout.

5. A plastic housing portion used to make a tub box for receiving a drain trap comprising a plurality of continuous side walls forming a hollow enclosure open at one end and closed at an other end, said open end being surrounded by a radial outturned edge flange, at least one round knockout in at least one of said side walls which when removed forms a round opening in said one side wall, at least one edge flange knockout in said edge flange and said one side wall in line with said round knockout, said edge flange knockout terminating in close proximity to said round knockout whereby when said edge flange knockout is removed along with said round knockout, a knockout opening is formed in said one side wall that extends to the open end of said housing portion, and a pull tab protruding outwardly from said round knockout, said side walls being tapered from said open end to said closed end to permit a plurality of identical housing portions to be stacked inside one another, said pull tab being located a predetermined distance from said closed end of said housing portion to limit the amount of nesting of a plurality of said housing portions inside one another so that said housing portions won't stick together when pulled apart.

6. The housing portion of claim 5 further comprising reinforcement ribs on an underside of said edge flange, said ribs terminating in line with said pull tab to create in cooperation with said pull tab a series of stacking stops to limit the amount of nesting of said housing portions inside one another.

7. A plastic housing portion used to make a tub box for receiving a drain trap comprising a plurality of continuous side walls forming a hollow enclosure open at one end and closed at an other end, said open end being surrounded by a radial outturned edge flange, at least one round knockout in at least one of said side walls which when removed forms a round opening in said one side wall, at least one edge flange knockout in said edge flange and said one side wall in line with said round knockout, said edge flange knockout terminating in close proximity to said round knockout whereby when said edge flange knockout is removed along with said round knockout, a knockout opening is formed in said one side wall that extends to the open end of said housing portion, and concentric smaller and larger diameter round knockouts in said closed end of said housing portion, said smaller diameter knockout being formed by a thinner frangible section in said closed end than said larger diameter knockout to permit removal of said smaller diameter knockout without removing said larger diameter knockout.

8. A tub box for receiving a drain trap comprising identical plastic top and bottom housing portions each having a plurality of continuous side walls forming a hollow enclosure open at one end and closed at an other end, said open end of each of said housing portions being surrounded by a radial outturned edge flange, the edge flange of each of said housing portions being in mating engagement with one another, a round knockout in one of said side walls of said housing portions which when removed forms a round opening for receipt of a round pipe for connection to a drain trap within said tub box, and an edge flange knockout in said edge flange and said one side wall in line with said round knockout, said edge flange knockout terminating in close proximity to said round knockout, whereby when said edge flange knockout is removed along with said round knockout, a generally U-shaped knockout opening is formed in said one side wall that extends to the open end of the associated housing portion, said round knockout being formed by a thinner frangible section in said one side wall than said edge flange knockout to permit removal of said round knockout without removing said edge flange knockout.

9. A tub box for receiving a drain trap comprising identical plastic top and bottom housing portions each having a plurality of continuous side walls forming a hollow enclosure open at one end and closed at an other end, said open end of each of said housing portions being surrounded by a radial outturned edge flange in mating engagement with one another, one or more round knockouts in one or more of said side walls which when removed form a round opening for receipt of a round pipe for connection to a drain trap within said tub box, and a pull tab protruding outwardly from said round knockout, said side walls of each of said housing portions being tapered from said open end to said closed end to permit a plurality of said housing portions to be stacked inside one another, said pull tab on each of said housing portions being located a predetermined distance from said closed end of each of said housing portions to limit the amount of nesting of said housing portions inside one another so that said housing portions won't stick together when pulled apart.

10. The tub box of claim 9 further comprising reinforcement ribs on an underside of said edge flange of each of said housing portions, said reinforcement ribs terminating in line with said pull tab on each of said housing portions to create in cooperation with said pull tab a series of stacking stops to limit the amount of nesting of said housing portions inside one another.

11. The tub box of claim 9 further comprising an edge flange knockout in one or more of said side walls of each of said housing portions in line with said round knockout, said edge flange knockout terminating in close proximity to said round knockout, whereby when said edge flange knockout is removed along with said round knockout, a generally U-shaped knockout opening is provided in one of said side walls that extends to the open end of said housing portion.

12. The tub box of claim 11 wherein said round knockout is formed by a thinner frangible section in one of said side walls than said edge flange knockout to permit removal of said round knockout without removing said edge flange knockout.

13. The tub box of claim 9 further comprising a plurality of axially spaced score lines in said side walls of said housing portions for ease of shearing off an upper end of said top housing portion above a concrete slab when poured around said tub box, said score lines being on an exterior surface of said side walls making said score lines easily visible from the exterior of said tub box.

14. A tub box for receiving a drain trap comprising identical plastic top and bottom housing portions each having a plurality of continuous side walls forming a hollow enclosure open at one end and closed at an other end, said open end of said housing portions being surrounded by radial outturned edge flanges extending radially outwardly of said side walls, said edge flanges being in mating engagement with one another, and a lip extending axially outward from an outer edge of said edge flanges around one half only of the periphery of each of said housing portions for overlapping the outer edge of the other housing portion to locate and align said housing portions with respect to one another and to act as a dam preventing concrete or dirt placed around said tub box from entering said tub box between said edge flanges, said edge flanges being adhesively bonded together. Said overlapping lips acting as a dam to hold a bead of adhesive between said edge flanges.

15. The tub box of claim 14 further comprising a plurality of round knockouts in one or more of said side walls which when removed form a round opening for receipt of a round pipe, and pull tabs protruding outwardly from said round knockouts.

16. The tub box of claim 15 wherein said side walls of said housing portions are tapered from said open end to said closed end to permit a plurality of said housing portions to be stacked together, and said pull tabs are located a predetermined distance from said closed end of said housing portions to limit the amount of nesting of said housing portions inside one another so that said housing portions won't stick together when pulled apart.

17. The tub box of claim 16 further comprising reinforcement ribs on an underside of said edge flanges, said reinforcement ribs terminating in line with said pull tabs to create in cooperation with said pull tabs a series of stacking stops to limit the amount of nesting of said housing portions inside one another.

18. The tub box of claim 15 further comprising a plurality of edge flange knockouts in said edge flange and one or more of said side walls in line with said round knockouts, said edge flange knockouts terminating in close proximity to said round knockouts, whereby when one of said edge flange knockouts is removed along with one of said round knockouts, a knockout opening is formed in said side wall that extends to the open end of the respective housing portion.

19. The tub box of claim 18 wherein said round knockouts are formed by a thinner frangible section in said side walls than said edge flange knockouts whereby said round knockouts can be removed by pulling on said tabs without removing said edge flange knockouts.

20. The tub box of claim 14 further comprising concentric smaller and larger diameter round knockouts in said closed end of each of said housing portions, said smaller diameter knockout being formed by a thinner frangible section in said closed end than said larger diameter knockout to permit removal of said smaller diameter knockout without removing said larger diameter knockout.

21. The tub box of claim 20 further comprising a pull tab protruding outwardly from said smaller diameter knockout.

22. The tub box of claim 14 further comprising a plurality of axially spaced, circumferentially extending score lines in said side walls of said housing portions for ease of breaking or sawing off an upper end of said top housing portion above a concrete slab poured around the tub box.

* * * * *